US005752426A

United States Patent [19]

Ikei et al.

[11] Patent Number: 5,752,426

[45] Date of Patent: May 19, 1998

[54] PILOT PRESSURE OPERATED DIRECTIONAL CONTROL VALVE AND AN OPERATING CYLINDER CONTROL APPARATUS

[75] Inventors: Kazunori Ikei; Keisuke Taka, both of Tochigi-ken, Japan

[73] Assignee: Komatsu Ltd., Tokyo, Japan

[21] Appl. No.: 714,166

[22] PCT Filed: Mar. 29, 1995

[86] PCT No.: PCT/JP95/00601

§ 371 Date: Sep. 27, 1996

§ 102(e) Date: Sep. 27, 1996

[87] PCT Pub. No.: WO95/26476

PCT Pub. Date: Oct. 5, 1995

[30] Foreign Application Priority Data

| | | | |
|---|---|---|---|
| Apr. 4, 1909 | [JP] | Japan | 6-065823 |
| Mar. 29, 1994 | [JP] | Japan | 6-058895 |
| Jul. 12, 1994 | [JP] | Japan | 6-159963 |

[51] Int. Cl.[6] ..... F15B 13/042; F15B 13/08

[52] U.S. Cl. ..... 91/447; 91/451; 91/529; 137/596.18; 137/596.2; 137/625.66; 251/151

[58] Field of Search ..... 91/447, 451, 529; 137/596.18, 596.2, 625.66; 251/151

[56] References Cited

U.S. PATENT DOCUMENTS 4,417,502 11/1983 Shore .

4,570,672 2/1986 Wilke ..... 137/596.18 X

FOREIGN PATENT DOCUMENTS

| | | |
|---|---|---|
| 0331076A | 9/1989 | European Pat. Off. . |
| 51-138691 | 11/1976 | Japan . |
| 57-46103 | 5/1982 | Japan . |
| 58-203272 | 11/1983 | Japan . |
| 59-30922 | 7/1984 | Japan . |
| 60-4602 | 1/1985 | Japan . |
| 2-91201 | 7/1990 | Japan . |
| 3-172602 | 7/1991 | Japan . |
| 4-134969 | 12/1992 | Japan . |

*Primary Examiner*—Gerald A. Michalsky

*Attorney, Agent, or Firm*—Wenderoth, Lind & Ponack

[57] ABSTRACT

A pilot pressure operated directional control valve is provided in which a housing is formed therein with a spool having a plurality of ports. The spool bore has a spool fittingly inserted therein so as to be slidably displaceable therein and the spool is slidably displaced both by a spring and under a pilot pressure led into a pressure receiving chamber. Also a spring box is attached to an end surface of the housing in a longitudinal direction of the spool. The spring box is provided with a hollow portion which contains the spring while forming a pressure receiving chamber, as well as a pilot pressure fluid inlet that communicates with the hollow portion and is open in the longitudinal direction of the spool.

13 Claims, 14 Drawing Sheets

PILOT PRESSURE OPERATED DIRECTIONAL CONTROL VALVE AND AN OPERATING CYLINDER CONTROL APPARATUS

TECHNICAL FIELD

This invention relates to a pilot pressure operated directional control valve for switching the flows of a pressure fluid by slidably displacing a spool under a pilot pressure, and to an apparatus for controlling an operating cylinder by using such a directional control valve in which a boom cylinder, an arm cylinder or a bucket cylinder of a power shovel or the like operating cylinder is supplied with a pressure fluid so as to control an operating extension and an operating retraction thereof.

BACKGROUND ART

A certain pilot pressure operated directional control valve has hitherto been known as disclosed in Japanese Unexamined Patent Publication No. Hei 3-172602.

Thus, it is known that in such a directional control valve, as shown in FIG. 1 of the accompanying drawings hereof, a housing 1 is formed therein with a spool bore 2 to which a pump port 7, a first and a second actuator port 8 and 9, and a first and a second tank port 10 and 11 are opened. The spool bore 2 has a spool 3 fittingly inserted therein whereas the housing 1 has a pair of spring boxes 4 disposed at its left hand side and right hand side, respectively. The spool 3 is adapted to assume a neutral position when it is energized by a spring 5 provided in one of the spring boxes 4 and is adapted to be slidably displaced either against, or in a cooperation with, a resilient force by the spring 5 to take a first position or a second position by supplying a pilot pressure fluid into one of pressure receiving chambers 6 formed in the left hand side and right hand side spring boxes 4, respectively, to establish and block communication between the pump port 7 and the first or second actuator ports 8 or 9, and communication between the first or second actuator ports 8 or 9 and the first or second tank ports 10 or 11.

This notwithstanding, however, such a pilot pressure operated directional control valve is constructed in such a way that the spring 5, the one pressure receiving chamber 6 and a pilot pressure fluid inlet 12 are formed successively on an axis that is coaxial with the spool 3. Since in addition the pilot pressure fluid inlet 12 must be made to have such a length that a piping joint such as an elbow can be in threaded engagement therewith, the corresponding spring box 4 needs to be proportionally lengthened. As a consequence, a problem arises in that the length of the entire directional control valve is necessarily increased and the area of the site on which it is mounted (i. e. a site area) is so enlarged.

Here, whilst if the pilot pressure fluid inlet is formed on a plane that is orthogonal to the spool longitudinal direction of the spring box 4, the length of the spring box 4 can be shortened, then if a plurality of such housings 1 are stacked one upon another and connected together, a problem is brought about in that a piping joint as mentioned above cannot be connected to the pilot pressure fluid inlet since the interstice between the adjacent spring boxes 4 is necessarily small in size.

Furthermore, in such a pilot pressure operated directional control valve, it may be noted that in order for a pilot pressure fluid to be supplied into the pressure receiving chambers 6, a piping joint assembly such as including an elbow must be threaded into and thereby attached to the pilot pressure fluid inlet 12 of the spring box 4.

For example, as shown in FIG. 2 of the accompanying drawings thereof, the pilot pressure fluid inlet 12 can be a threaded bore into which the threaded portion 14 of a piping joint 13 may be inserted for a mating engagement therewith.

With such a construction adopted, in order for the piping joint 13 to be firmly attached to the said spring box 4 and for a fluid leakage from their threaded engagement connection to be prevented, the threaded connection length between the piping joint 13 and the pilot pressure fluid inlet 12 of the spring box 4 needs to be increased. Thus, the threaded portion of the pilot pressure fluid inlet 12 of the spring box 4 engaged with the piping joint 13 being lengthened, the length of the spring box 4 will be increased. For this reason, there has hitherto developed the problem that the entire size of a directional control valve of this type must be increased in length and the area of the site on which it is mounted (i. e. the site area) needs to be enlarged.

Also, if the piping joint 13 has a pipe connecting portion 15 that is not aligned linearly with the threaded portion 14 but its alignment therewith is L-shaped as shown, it is naturally difficult to orient the pipe connecting portion 15 in a desired direction. More specifically, whilst if a plurality of such directional control valves are stacked one upon another, adjacent pilot pipe lines can readily be interconnected by orienting their corresponding pipe connecting portions 15 in an identical direction, if a threaded attaching arrangement as mentioned above is then employed for a piping joint 13, it is altogether possible that the pipe connecting portions 15 may not be oriented uniformly.

The present invention has been made to obviate such inconveniences and has for its one object to provide a pilot pressure operated directional control valve which is capable of reducing the length of the entire pilot pressure operated directional control valve in the prior art, thereby reducing the site area; which, if a plurality of housings are stacked one upon another and thereby interconnected, is capable of connecting a piping joint to a pilot pressure fluid inlet; and which, if a pipe connecting portion of a piping joint is L-shaped, is capable of orienting a plurality of such piping connection portions in an identical direction.

One may also note at this point that a conventional apparatus for controlledly supplying a pressure fluid into an operating cylinder is typically constructed in such a manner that the pressure fluid discharged from a hydraulic pump is supplied into one of a first and a second chamber of the operating cylinder under the control by a pilot pressure operated directional control valve while a pressure fluid is discharged from the other of the first and second chambers into a reservoir, thereby performing an extending or retracting operation of the operating cylinder.

In such an apparatus, the pilot pressure operated directional control valve has a valve block that is formed therein with a spool bore to which a pump port, a first and a second actuator port and a tank port are opened. The spool bore has a spool fittingly inserted therein so as to be slidably displaceable therein. The spool can be switched from its neutral position to its first or second position to establish a communication between the pump port and one of the first and second actuator ports and a communication between the tank port and the other of the first and second actuator ports, thereby permitting the pressure fluid to be supplied and discharged as mentioned above. Also, the spool can be set at its neutral position to block each of these ports, thereby preventing a return fluid, caused to flow into the first or second actuator port, from flowing out into the reservoir.

It should be noted, however, that between the spool and the spool bore in the valve block there exists small clearance which may allow for a fluid leakage and that a retention pressure would, owing to an external load, be produced in the first or second chamber in the operating cylinder. The retention pressure will then cause a portion of the return oil to flow through the above mentioned clearance into the reservoir. It follows, therefore, that the operating cylinder will undesirably have either an extending operation or a retracting operation (hereinafter referred to as a "spontaneous fall").

For this reason, the prior art has adopted an arrangement in which a circuit for interconnecting the retention pressure producing chamber of the operating cylinder and the actuator ports of the directional control valve is provided with a locking valve which will, when the directional control valve is at its neutral position, be closed to act to prevent the return fluid, out of the operating cylinder, from flowing into a actuator port of the directional control valve and thus to prevent a spontaneous fall. On the other hand, when the directional control valve is at its first or second position, the locking valve will be opened to allow the pressure fluid to flow between the directional control valve and the operating cylinder.

However, if such a locking valve is incorporated as mentioned above, the retention pressure will be abnormally elevated when the operating cylinder is acted upon by an inertia load or an external force.

Thence, there has been known an operating cylinder controlling apparatus that is designed to resolve this problem in the prior art, as disclosed in FIG. 3 of Japanese Unexamined Utility Model Publication No. Hei 2-91201, which is provided with a locking valve, called a sequence valve, in a circuit for interconnecting one of the actuator ports of the directional control valve and the retention pressure producing chamber of the operating cylinder, as well as a relieve valve in a circuit between the locking valve and the operating cylinder, in such a manner that if the retention pressure is elevated when the operating cylinder is acted upon by a load of inertia or an external force, the relief valve may provide a relieving action for the pressure fluid into the reservoir.

There has also be known another operating cylinder controlling apparatus, as disclosed in FIG. 1 of Japanese Unexamined Utility Model Publication No. Hei 2-91201.

This latter known apparatus, as shown in FIG. 3 of the accompanying drawings hereof, is provided with a locking valve 206, then called a logic valve, in a circuit 205 for connecting one actuator port 202 of a directional control valve 201 and a retention pressure producing chamber 204 of an operating cylinder 203 together, as well as a pilot valve 209 for establishing and blocking a communication between a spring chamber 207 of the locking valve 206 and a reservoir 208. Then, the pilot valve 209 has a pressure receiving chamber connected to a relief valve 210 and the circuit 205 has a connection to a main relief valve 211. Here, if the retention pressure in the retention pressure producing chamber 204 of the operating cylinder 203 is elevated, the pilot relief valve 210 will act to relieve the pressure fluid to bring the pilot valve 209 to its communicating position with the pressure fluid relieved, thereby communicating the spring chamber 207 of the locking valve 206 with the reservoir 208. The locking valve will thus be opened to communicate the retention pressure producing chamber 204 with the circuit 205. As a result, the retention pressure within the operating cylinder 203 will be relieved through the main relief valve 211 and eventually set free.

Of the above mentioned two operating cylinder controlling apparatuses in the prior art, if the former is adopted, it follows that the need to handle a large volumetric flow of the pressure fluid requires a relief valve to be necessarily large in size and hence any combined unit of the relief valve and the locking valve to also be large in size. Furthermore, if a plurality of such operating cylinders are involved as is typically the case, a like plurality of such units need to be installed, thus giving rise to the problematical requirement that the area for their installation be necessary which needs to be increased in proportion to the number of the units.

On the other hand, if the latter type of the control apparatus is adopted, it follows that the use of the locking valve 206, the pilot valve 209 and the pilot relief valve 210, an increased number of components, makes the equipment not only costly but also large in size. Therefore, the problem of the requirement of an enlarged installation site, here again, arises, if a plurality of operating cylinders need to be controlled as in the previous case.

Accordingly, the present invention has been made also to obviate the inconveniences discussed in the preceding paragraphs and has for another object to provide an operating cylinder controlling apparatus which is reduced both in its cost and area of installation for a unit designed to prevent any spontaneous fall of an operating cylinder.

SUMMARY OF THE INVENTION

In order to achieve the foregoing objects, there is provided in accordance with the present invention, in a first aspect thereof, a pilot pressure operated directional control valve in which a housing is formed therein with a spool bore having a plurality of ports. The spool bore has a spool fittingly inserted therein so as to be slidably displaceable therein and the spool is adapted to be slidably displaced both with a spring and under a pilot pressure led into a pressure receiving chamber, and in which:

a spring box is attached to an end surface of the housing in a longitudinal direction of the spool; and the spring box is adapted to be formed therein with a hollow portion containing a spring and forming a pressure receiving chamber, and a pilot pressure fluid inlet for communicating with the hollow portion and opening in the longitudinal direction of the spool.

According to the construction mentioned above, it can be seen that the pilot pressure fluid inlet will no longer project largely from the hollow portion in the longitudinal direction of the spool and, as a result, the length of the spring box may be reduced, This will in turn shorten the entire pilot pressure operated directional control valve, thus reducing its required site area.

Also, since the pilot pressure fluid inlet is opening in the direction of the spool, it can be seen that if a plurality of housings are stacked one upon another and thereby interconnected, an individual pilot pressure fluid inlet may have a corresponding piping joint connected thereto.

Preferably, the spring box comprises a first cylindrical body and a second cylindrical body which are integrally arranged in a pair and in parallel to each other and which are opening to a left hand side and right hand side which are opposite to each other. The hollow portion is formed within the first cylindrical body, and an interior of the second cylindrical body is adapted to be in a communication with an interior of the first cylindrical body. Also, the pilot pressure fluid inlet is constituted with an opening portion of the second cylindrical body.

It is also preferred that a piping joint should be connected to the pilot pressure fluid inlet.

It is further desirable that the pilot pressure fluid inlet be formed with a piping joint attachment hole, that the piping joint attachment hole be constituted of a large diameter hole and a small diameter hole which are eccentric to each other, that a piping attachment joint be constituted of a fitting portion comprising a large diameter portion and a small diameter portion which are eccentric to each other and a pipe connecting portion, that the fitting portion be adapted to be fittingly inserted into the piping joint attachment hole, and that a pressure plate be bolted with the spring box to act to prevent the fitting portion from coming out of the piping joint attachment hole.

According to the construction just mentioned above, it can be seen that the length along which the fitting portion of the piping joint is fittingly inserted into the piping joint attachment hole of the spring box may be shortened. Since the piping joint attachment hole of the spring box can thus be reduced in length, the length of the spring box will be shortened, thereby reducing the entire length of the pilot pressure operated directional control valve, thus making its required site area smaller.

It can also be seen that with such a pressure plate the piping joint may effectively be prevented from coming out of the piping joint attachment hole. Also, since a large diameter portion and a small diameter portion which are eccentric to each other are fitted, respectively, into a large diameter hole and a small diameter hole which are eccentric to each other, there will be no rotation of the piping joint and its firm attachment will thereby be ensured. If an L-shaped piping joint is adopted, it will be noted that its pipe connecting portion can always be oriented in a predetermined direction.

It is also possible that the pilot pressure fluid inlet may be formed with the piping joint attachment hole, that the piping joint attachment hole may be in the form of a regular polygon, that the piping joint may be constituted of a fitting portion in the form of a regular polygon and a pipe connecting portion, that the fitting portion may be adapted to be fittingly inserted into the piping joint attachment hole, and that a pressure plate may be bolted with the spring box to act to prevent the fitting portion from coming out of the piping joint attachment hole.

According to the construction just mentioned above, it can be seen that the orientation of the pipe connection portion of the piping joint may be altered in accordance with a particular regular polygonal configuration and thus by the number of corners of the particular regular polygon.

It should be noted at this point that it is desirable that an interstice between an inner peripheral portion of the joint attachment hole and an outer peripheral portion of the fitting portion be adapted to be sealed by a sealing material, or that an interstice between a bottom portion of the piping joint attachment hole and an end surface of the fitting portion be adapted to be sealed by a sealing material.

The present invention also provides, in a second aspect thereof, an operating cylinder control apparatus, which comprises:

a directional control valve;

a locking valve which is disposed in a circuit for interconnecting an actuator port of the directional control valve and a retention pressure generating chamber of the operating cylinder, which has a pressure receiving portion and a spring, which is adapted to be thrust in a direction of communication by an outlet pressure of the directional control valve and the retention pressure within the operating cylinder and which is adapted to be thrusted in a blocking direction by the retention pressure within the operating cylinder and the spring. The retention pressure acts on the pressure receiving portion.

A switching valve is disposed between the pressure receiving portion of the locking valve and a reservoir, which is adapted to be energized by the spring to take its blocking position and which is adapted to take its communicating position by means of a switching means brought into a position for communicating the circuit with a reservoir.

Also a main relief valve is connected via a check valve to a side to the operating cylinder of the rocking valve in the circuit.

According to the construction just mentioned above, it can be seen that since the main relief valve for preventing an abnormally elevated pressure within the retention pressure generating chamber of the operating cylinder can be placed separately, it will be sufficient to provide only the locking valve and the switching valve correspondingly to each of the operating cylinders. And yet, since the main relief valve can commonly act for a plurality of operating cylinders, the area of the site on which a unit for preventing a spontaneous fall of any of the plural operating cylinders is mounted may be reduced. Also, since it suffices to provide such a single main relief valve alone, it can be seen that the equipment may be made less costly.

In the construction just mentioned above, it should be noted here that it is desirable that a valve block equipped with the locking valve and the switching valve be connected to a valve block of the directional control valve, that an inlet side of locking valve be adapted to communicate with the actuator port of the directional control valve, and that each of the valve blocks be formed therein with a fluid bore for communicating the pressure receiving portion on which the pilot pressure of the directional control valve is acting with the pressure receiving portion of a side to the spring of the switching valve.

It should further be noted that an operating cylinder control apparatus as mentioned may specifically comprise:

a directional switch valve which is provided with a pump port, a tank port and a first and a second actuator port, which when at its neutral position is adapted to block the first and second actuator ports, which when at its first pressure fluid supply position is adapted to communicate between the pump port and the first actuator port and to communicate between the second actuator port and the tank port, and which when at its second pressure fluid supply position is adapted to communicate between the pump port and the second actuator port and to communicate the first actuator port and the tank port.

A first circuit is provided for connecting the first actuator port to a retention pressure generating chamber of the operating cylinder.

A second circuit is provided for connecting the second actuator port to the other chamber of the operating cylinder.

A locking valve is disposed in the first circuit. The locking valve is adapted to be thrust in a direction of communication both under a pressure of the first actuator port and under a pressure within the retention pressure generating chamber. Also, the locking valve is adapted to be thrust in a direction of blocking both by a spring and under the pressure within the retention pressure generating chamber acting on a pressure receiving portion.

A switching valve is disposed in a drain path connected to the pressure receiving portion of the locking valve. The switching valve is held at a blocking position by a spring, and is brought to a communicating position under a pressure at the pressure receiving portion.

Also a main relief valve is connected to a side to the retention pressure generating chamber of the locking valve in the first circuit and to the second circuit via respective check valves, and may have a construction in which the second pressure receiving chamber of the directional control valve is connected to the pressure receiving portion of the switching valve.

BRIEF DESCRIPTION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

BEST MODES FOR CARRYING OUT THE INVENTION

Hereinafter, suitable embodiments of the present invention with respect to a pilot pressure operated directional control valve and an operating cylinder control apparatus using the same will be set forth with reference to the accompanying drawings hereof.

Figure 1:
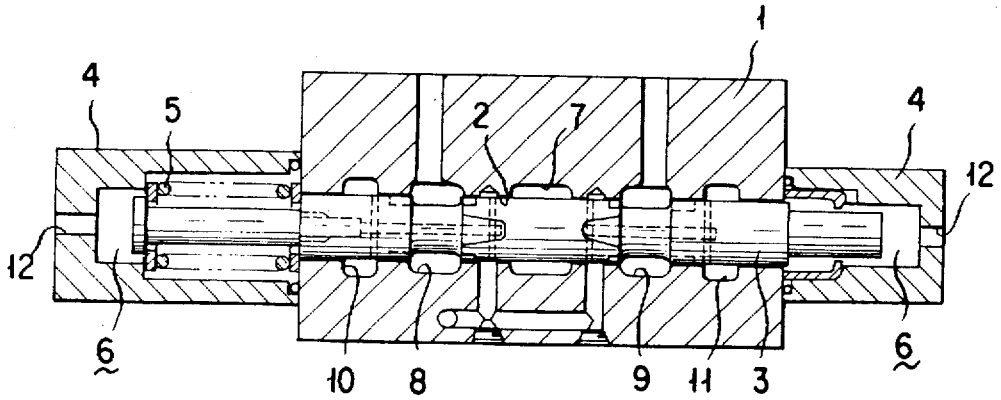
FIG. 1 is a cross sectional view of a pilot pressure operated directional control valve in the prior art.
Figure 2:
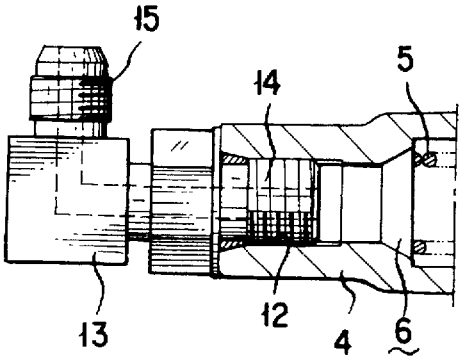
FIG. 2 is a cross sectional view of a piping joint attachment portion in the above mentioned example in the prior art.
Figure 3:
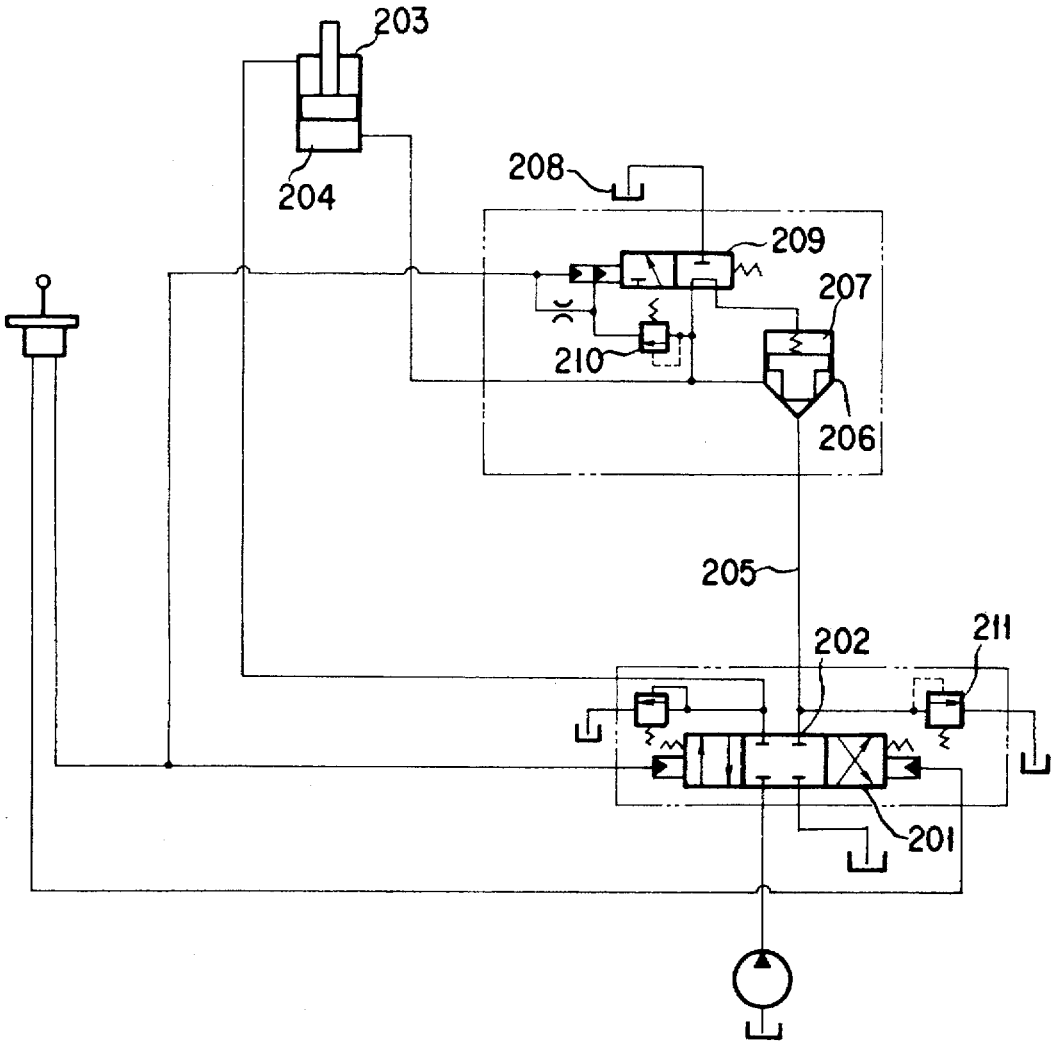
FIG. 3 is a hydraulic circuit diagram of an operating cylinder control apparatus in the prior art.
Figure 4:
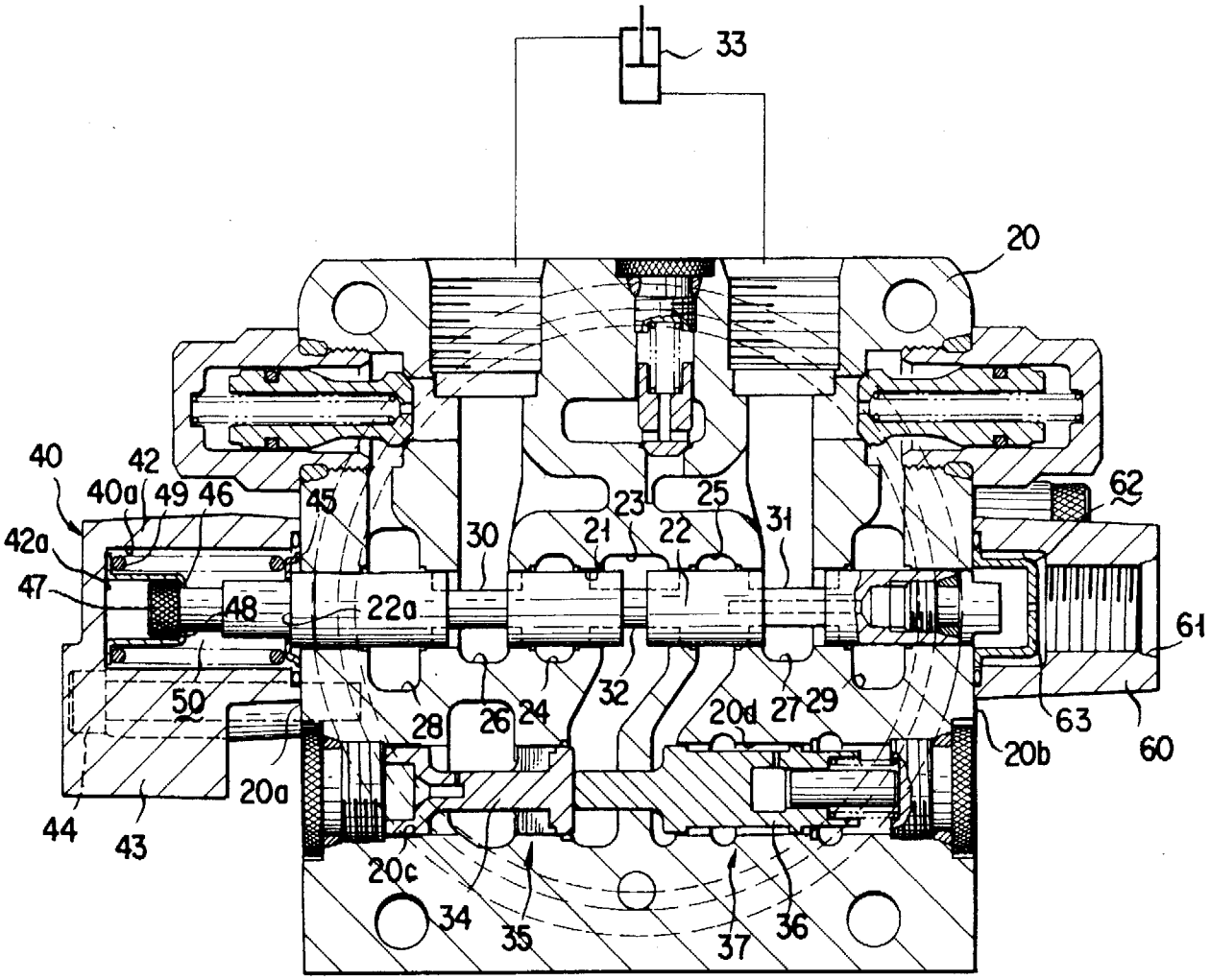
FIG. 4 is a cross sectional view of a first embodiment of a pilot pressure operated directional control valve according to the present invention.

As shown in FIG. 4, a housing 20 is formed therein with a spool bore 21 to which a pump port 23, a first and a second load pressure detecting port 24 and 25, a first and a second actuator port 26 and 27 and a first and a second tank port 28 and 29 are opened. The spool bore 21 has a spool 22 fittingly inserted therein. The above mentioned spool 22 is formed with a first and a second small diameter portion 30 and 31 and an intermediate small diameter portion 32 so that when located at its neutral position as shown in FIG. 4, it may block each of the ports mentioned above. And, when the spool 22 is slidably displaced rightwards in FIG. 4 to take its first position, communication will be established each between the pump port 23 and the second load pressure detecting port 25, between the first load pressure detecting port 24 and the first actuator port 26, and between the second actuator port 27 and the second tank port 29. It should be noted here that the first load pressure detecting port 24 and the second load pressure detecting port 25 remain communicated with each other at all times. It can accordingly be seen that a pressure fluid caused to flow into the pump port 23 will flow through the first actuator port 26 into an actuator 33 whereas a return fluid out of the actuator 33 will flow through the second actuator port 27 into the tank port 29.

Also, if the spool 22 is slidably displaced from the state of FIG. 4 leftwards to take its second position, communication will be established each between the pump port 23 and the first load pressure detecting port 24 and between the second load pressure detecting port 25 and the second actuator port 27. Since the first load pressure detecting port 24 and the second load pressure detecting port 25 remain in communication with each other at all times as mentioned above, the pressure fluid in the pump port 23 will flow into the actuator 33. Also, since the first actuator port 26 is caused to communicate with the first tank port 28, the return fluid out of the actuator 33 will flow into the first tank port 28 mentioned above.

At this point it should be noted that in FIG. 4, a spool 34 is inserted in a check valve bore 20*c* and constitutes a check valve component 35 whereas a spool 36 is inserted in a pressure reduction valve bore 20*d* and constitutes a pressure reduction valve component 37. The check valve component 35 and the pressure reduction valve component 37 together constitute a pressure compensation valve.

Figure 5:
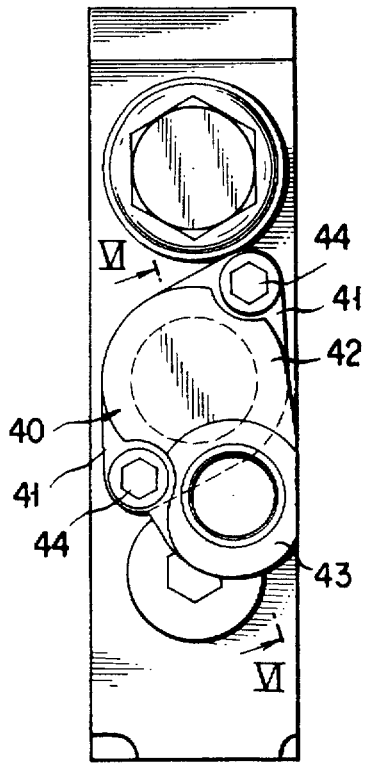
FIG. 5 is a left hand side view of the structure shown in FIG. 4.
Figure 6:
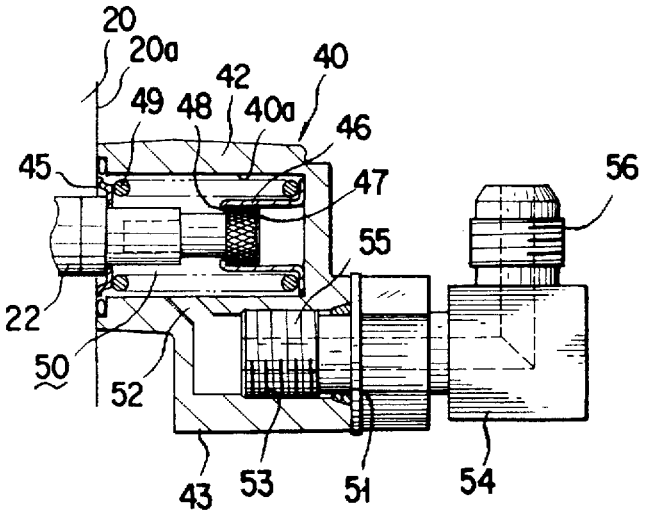
FIG. 6 is a cross sectional view taken along the line VI—VI of FIG. 5.

It is seen that a first spring box 40 is attached to one end surface 20*a* of the above mentioned housing 20 in the longitudinal direction of the spool 22. As shown in FIGS. 5 and 6, the first spring box 40 comprises a pair of a first cylindrical body 42 having an attachment seat 41 and a second cylindrical body 43 which is integrally mounted with, and extends in parallel to, the first cylindrical body 42 and which is opening to both a left hand side and a right hand side which are opposite to each other. The first cylindrical body 42 is secured by a bolt 44 to the housing 20 coaxially with the spool bore 21 and is provided therein with a first spring bearing 45 and a second spring bearing 46 so that the first spring bearing 45 may be in contact with both the one end 20*a* of the housing 20 and a step portion 22*a* of the spool 22 whereas the second spring bearing 46 may be in contact with both a bottom wall 42*a* of the first cylindrical body 42 and a step portion 48 of a bolt 47 secured to, or integral with, the spool 22. Here, a spring 49 is interposed between the first and second spring bearings 45 and 46 so that the spool 22 may be held at its neutral position. Note also that the interior of the first cylindrical body 42 constitutes a pressure receiving chamber 50. Thus, not only does the first cylindrical body 42 serve to contain the spring 49 but also it is provided therein with a hollow portion 40*a* that constitutes the pressure receiving chamber 50.

An outer end portion of the above mentioned second cylindrical body 43 is configured to open in a direction that is parallel to the longitudinal direction of the spool 22, and a portion at which the body 43 is open constitutes a pilot pressure fluid inlet 51. Also, an inner end portion of the second cylindrical body 43 is configured to communicate via a small diameter bore 52 with the interior (i. e., the pressure receiving chamber 50) of the first cylindrical body 42. Note further that the pilot pressure fluid inlet 51 is formed with a threaded portion 53, and that the pilot pressure fluid inlet 51 is located at an approximately identical position to the end of the pressure receiving chamber 50 in the direction in parallel to the longitudinal direction of the spool 22.

A first threaded portion 55 of a piping joint 54 such as an elbow is inserted into the threaded portion 53 of the pilot pressure fluid inlet 51 of the second cylindrical body 43 to establish a mating engagement therewith. A second threaded portion 56 of the piping joint 45 is fitted with an interiorly threaded pipe for a pilot pressure fluid to establish a mating connection therewith.

The first threaded portion 55 and the second threaded portion 56 mentioned above are configured to be L-shaped as a whole to enable the pipe for the pilot pressure fluid to be connected approximately in parallel to the one end surface 20*a* of the housing 20.

It is also seen that a second spring box 60 is attached to the other end surface 20*b* of the housing 20 in the longitudinal direction of the spool 22. The second spring box 60 is only formed with a pilot pressure fluid inlet 61 and a pressure receiving surface 62 and does not contain a spring.

That is to say, since the spool 22 can be held at its neutral position by the spring 49 disposed in the first spring box 42 and is also arranged to be slidably displaceable both leftwards and rightwards against the spring 49, there is no need to provide a spring within the second spring box 60. In this connection it should be noted that within the second spring box 62 there is provided a seat 63 that is designed to regulate a slidable displacement rightwards of the spool 22.

This being the case, it can be seen that the second spring box 60 if provided in the form of a cylindrical body may have a length that is reduced by the space in which a spring otherwise needs to be contained.

This notwithstanding, however, it is not definitely objectionable to replace the second spring box 60 with the first spring box 40 as one is to be attached there.

Figure 7:
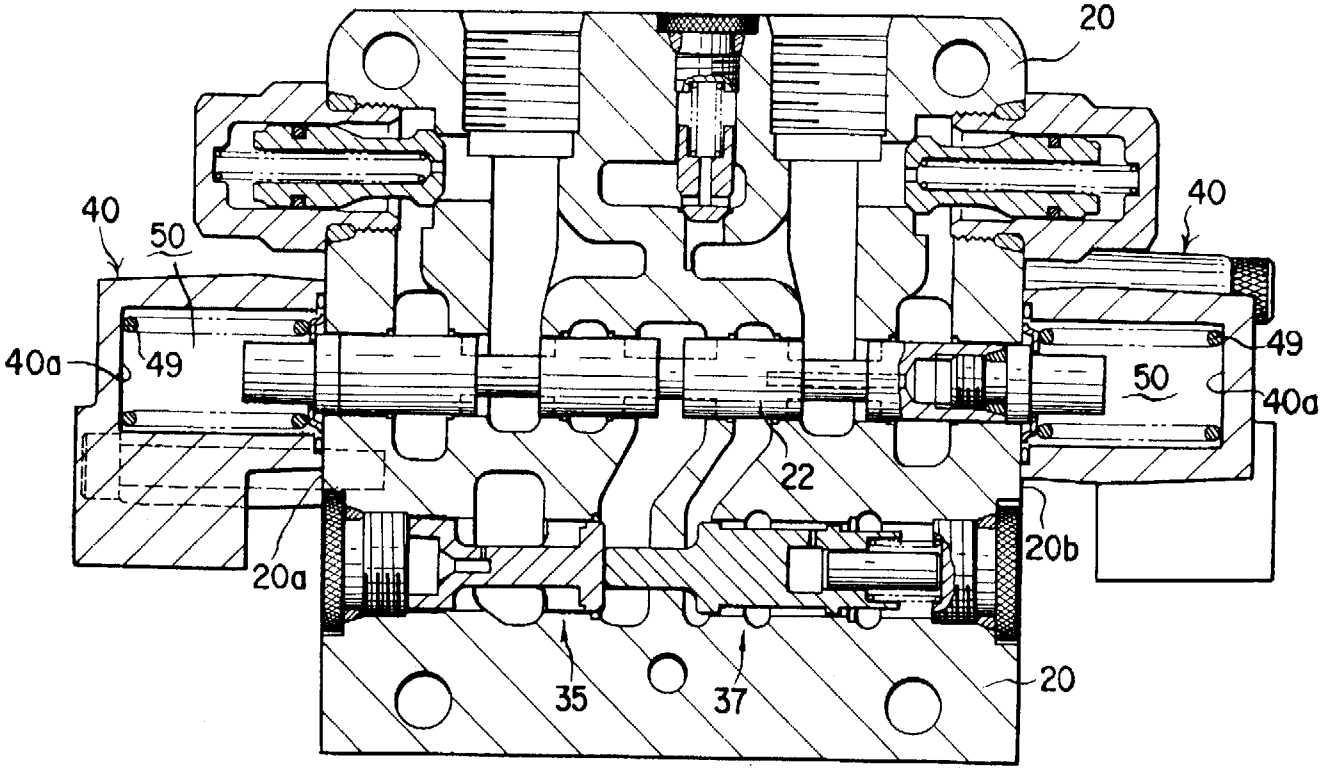
FIG. 7 is a cross sectional view of a second embodiment of a pilot pressure operated directional control valve according to the present invention.

FIG. 7 shows a second embodiment of the pilot pressure operated directional control valve according to the present invention. In the second embodiment, the one end surface 20*a* and the other end surface 20*b* of a housing 20 have each a first spring box 40 attached thereto and a spring 49 is contained in a first cylindrical body 42 for each such first spring box 40.

As will be apparent from the foregoing, if either the first or the second embodiment mentioned above is adopted in which there is included a pilot pressure fluid inlet 51 that is opening in a direction substantially in parallel to a hollow portion 40*a* which contains a spring 49 and constitutes a pressure receiving chamber 50 and in which the pilot pressure fluid inlet 51 is located at a substantially identical position to the end of the pressure receiving chamber 50 in a direction in parallel to the longitudinal direction of a spool 22, it can be seen that there will be no undesirable, large projection of the pilot pressure fluid inlet 51 from the hollow portion 40*a* in the longitudinal direction of the spool and, as a result, the length of the spring box 40 may be shortened. This will in turn shorten the entire length of a pilot pressure operated directional control valve, thus reducing its required site area.

Also, since the pilot pressure fluid inlet 51 is designed to open in a direction in parallel to the spool longitudinal direction, it can be seen that even in case a plurality of housings are stacked one upon another and thereby interconnected, such an individual pilot pressure fluid inlet 51 may have a piping joint readily connected thereto.

Figure 8:
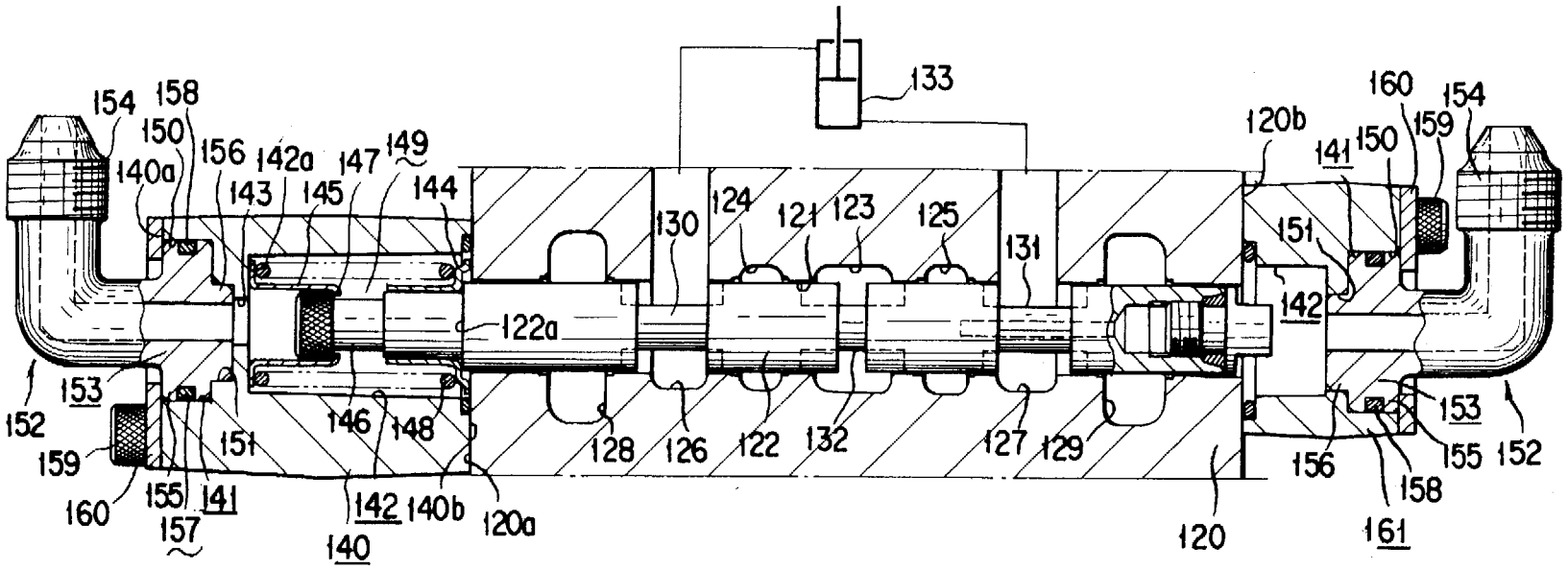
FIG. 8 is a cross sectional view of a third embodiment of a pilot pressure operated directional control apparatus according to the present invention.

FIG. 8 shows a third embodiment of the pilot pressure operated directional control valve according to the present invention.

As shown in FIG. 8, a housing 120 is formed therein with a spool bore 121 to which a pump port 123, a first and a second load pressure detecting port 124 and 125, a first and a second actuator port 126 and 127 and a first and a second tank port 128 and 129 are opened. The spool bore 121 has a spool 122 fittingly inserted therein. The spool 122 is formed with a first and a second small diameter portion 130 and 131 and an intermediate portion 132 so that when held at its neutral position it may block each of the ports mentioned above. And, if the spool 122 is slidably displaced rightwards in FIG. 8 to take its first position, communication will be established each between the pump port 123 and the second load pressure detecting port 125, between the first load pressure detecting port 124 and the first actuator port 126, and between the second actuator port 127 and the second tank port 129. It should be noted at this point that the first load pressure detecting port 124 and the second load pressure detecting port 125 remain communicated with each other at all the times. Accordingly, it can be seen that a pressure fluid caused to flow into the pump port 123 will flow through the first actuator port 126 into an actuator 133 whereas a return fluid out of the actuator 133 will flow through the second actuator port 127 into the second tank port 129.

If the spool 122 is slidably displaced from the state of FIG. 8 leftwards to take its second position, communication will be established each between the pump port 123 and the first load pressure 124 and between the second load pressure detecting port 125 and the second actuator port 127. Also, since the first load pressure detecting 124 and the second load pressure detecting port 125 remain in communication with each other at all times as mentioned above, it can be seen that the pressure fluid out of the pump port 123 will flow into the actuator 133. Then, also, the first actuator port 126 will communicate with the first tank port 128 to allow the return fluid out of the actuator 133 to flow into the first tank port 128.

It is seen that a first spring box 140 is attached to one end surface 120*a* of the above mentioned housing 120 in the longitudinal direction of the spool 122. The first spring box 140 is formed with a piping joint attachment hole 141 that is opening to one end surface 140*a* thereof, a spring attachment hole 142 that opens to the other end surface 140*b* thereof and a bore 143 for communicating these attachment holes 141 and 142 with each other. It is seen that a first spring bearing 144 and a second spring bearing 145 are disposed within the spring attachment hole 142 so that the first spring bearing 144 may be in contact with both the one end surface 120*a* of the housing 120 and a step portion 122*a* of the spool 122 whereas the second spring bearing 145 may be in contact with both a bottom wall 142*a* of the spring attachment hole 142 and a step portion 147 of a bolt 146 secured to or integral with the spool 122. It is also seen that a spring 148 is interposed between the first and second spring bearings 144 and 145 so that the spool 122 may be held at its neutral position. Also, the interior of the spring attachment hole 142 here constitutes a pressure receiving chamber 149.

Figure 9:
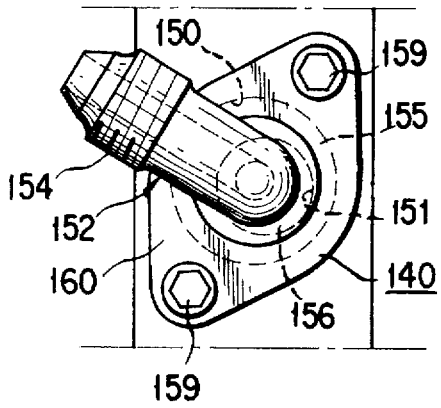
FIG. 9 is a left hand side view of the structure shown in FIG. 8.

As shown in FIGS. 8 and 9, the spring attachment hole 142 comprises a large diameter hole 150 and a small diameter hole 151 which are eccentric to each other. The large diameter hole 150 is open to the one end surface 140*a* of the spring box 140 whereas the small diameter hole 151 has a bottom portion thereof which is opening through the bore 143 to the spring attachment hole 142.

Figure 10:
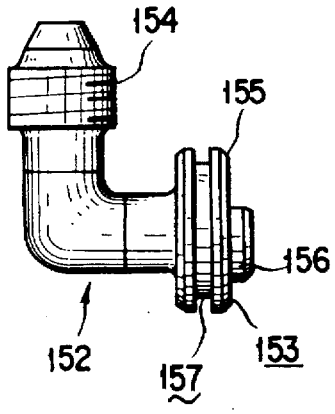
FIG. 10 is a front view of a piping joint in the above mentioned third embodiment of the present invention.

As shown in FIG. 10, a piping joint 152 comprises a fitting portion 153 and a pipe connecting portion 154 which are configured to be L-shaped as a whole. The fitting portion 153 comprises a large diameter portion 155 and a small diameter portion 156 which are eccentric to each other. The large diameter portion 155 is formed with an annular groove 157 on its outer peripheral surface.

As shown in FIGS. 8 and 9, the piping joint 152 has such a construction that the large diameter portion 155 and the small diameter portion 156 may be fitted in the large diameter hole 150 and the small diameter hole 151, respectively, of the first spring box 140, and thus is attached to the latter so that it may not be rotated. Also, an O-ring 158, which is fitted in the annular groove 157 of the large diameter portion 155, is pressed against, and thereby attached to, the inner peripheral surface of the large diameter hole 150 to provide a sealing between the piping joint 152 and the first spring box 140. Also, a pressure plate 160, which is attached by bolts 159 to the one end surface 140*a* of the first spring box 140, serves to prevent the piping joint 152 inserted from coming out.

This being the case, it will be seen that the attachment portion of the piping joint 152 to the first spring box 140 is sealed by the O-ring 158, the piping joint 152 inserted can be prevented from being removed by the pressure plate 160, and the piping joint 152 can be fixed in position so as to be not rotatable by means of the large diameter hole 150 and the small diameter hole 151 which are eccentric to each other, coupled with the large diameter portion 155 and the small diameter portion 156 which are eccentric to each other, and yet the orientation of the pipe connecting portion 154 of the piping joint 152 can be maintained always constant.

It is also seen that a second spring box 161 is attached to the other end surface 120*b* of the above mentioned housing 120 in the longitudinal direction of the spool 122. The second spring box 161, as with the first spring box 140, is provided with a piping joint attachment hole, here designated at 141, and a spring attachment hole, here designated at 142. The piping joint attachment hole 141 has a small diameter hole 151 that is directly open to the spring attachment hole 142 in which no spring is provided.

That is to say, since the spool 122 can be held at its neutral position by the spring 148 disposed within the first spring box 140 and is also arranged to be slidably displaceable both leftwards and rightwards against the spring 148, there is no need to provide a spring within the second spring box 161. In this connection, it should be noted that as in a previous embodiment, here again, a piping joint 152 is attached to the piping joint attachment hole 141, in the second spring box 161.

This being the case, it can be seen that the second spring box 161 may here again have a length that is reduced by the space in which a spring must otherwise be contained. This notwithstanding, however, it is not objectionable to replace the second spring box 161 with the first spring box 140 as one is to be attached there.

Figure 11:
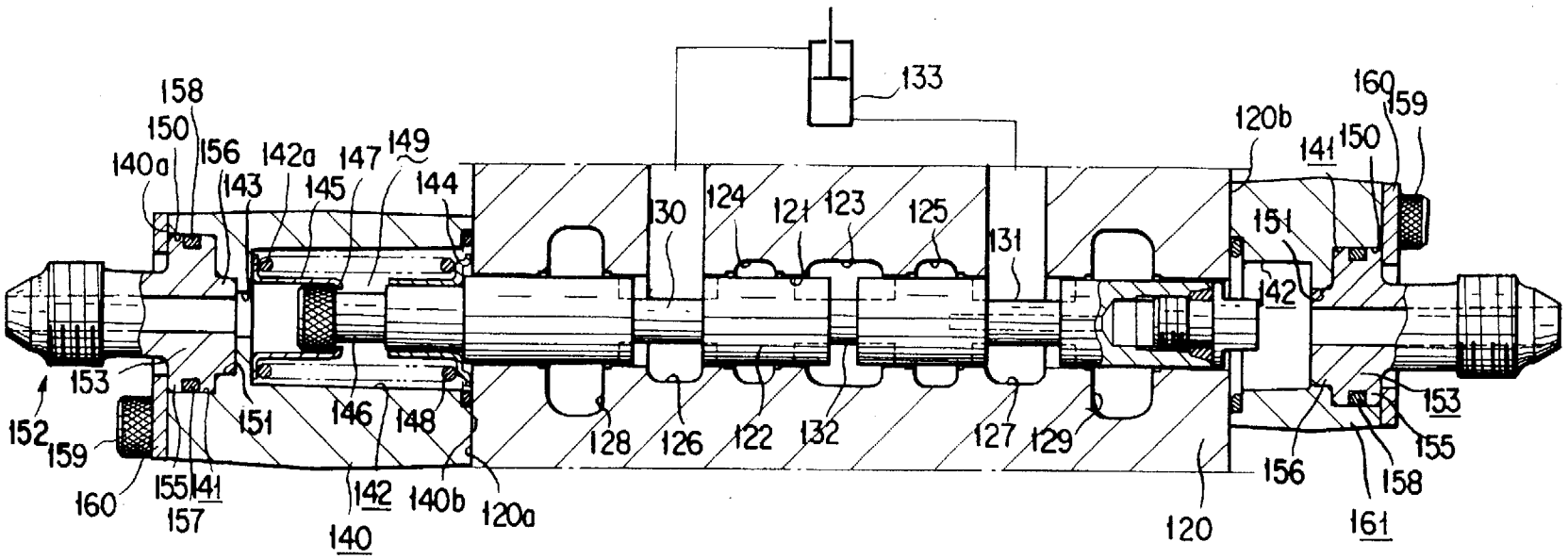
FIG. 11 is a cross sectional view of a fourth embodiment of a pilot pressure operated directional control valve according to the present invention.
Figure 12:
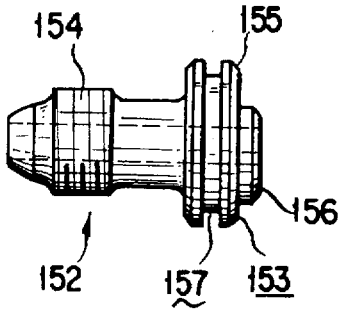
FIG. 12 is a front view of a piping joint in the above mentioned forth embodiment of the present invention.

It should also be noted that the piping joint 152, as in a fourth embodiment of the pilot pressure operated directional control valve as shown in FIGS. 11 and 12, may have a fitting portion 153 and a pipe connecting portion 154 linearly arranged.

As will be apparent from the preceding paragraphs, the above mentioned third and fourth embodiments of the present invention provide an arrangement whereby it is made possible to shorten the length along which the fitting portion 153 of the piping joint 152 is fitted into the piping joint attachment hole 141 of the spring box 140 while providing a required sealing with certainty. Therefore, since the piping joint attachment hole 141 of the spring box 140 can be shortened, it follows that the length of the spring box 140 will be shortened to reduce the entire length of the pilot operated directional control valve, thereby reducing its site area as required.

Also, the piping joint 152 inserted can be prevented by the pressure plate 160 from coming out. Further, since the large diameter portion 155 and the small diameter portion 156 which are eccentric to each other are, respectively, fitted in the large diameter hole 150 and the small diameter hole 151 which are eccentric to each other, it will be seen that the piping joint 152, without any fear of its subsequent rotation, can be, and does remain, attached firmly in place. In other words, the orientation of the pipe connecting portion 154 of the L-shaped piping joint 152 may be maintained always constant.

Figure 13:
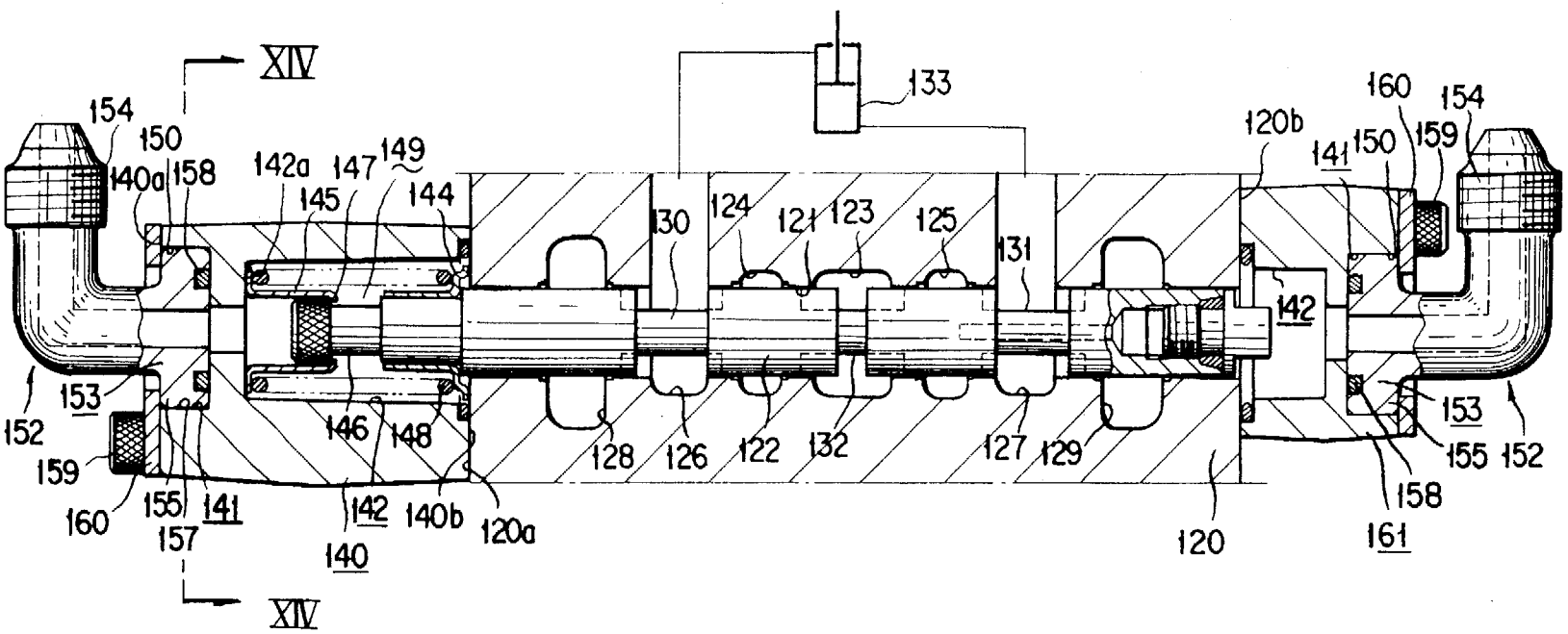
FIG. 13 is a cross sectional view of a fifth embodiment of a pilot pressure operated directional control valve according to the present invention.
Figure 14:
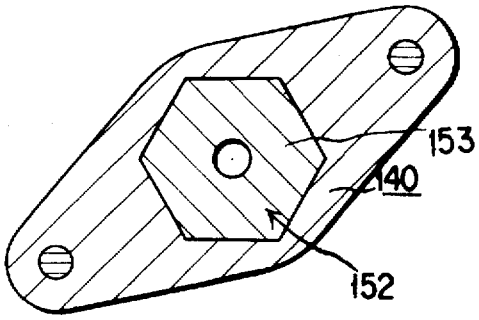
FIG. 14 is a cross sectional view taken along the line XIV—XIV of FIG. 13.

Also, as in a fifth embodiment of the pilot pressure operated directional control valve as shown in FIGS. 13 and 14, a piping joint attachment hole 141 of each of the first and second spring boxes 140 and 161 may be in the form of a regular polygon, and the fitting portion 153 of the piping joint 152 may also be in the form of a regular polygon that is identical to the above mentioned regular polygon. In this case, an O-ring 158 is fitted between the bottom portion of the piping joint attachment hole 141 and the end surface of the fitting portion 153. Then, the orientation of pipe connecting portion 154 of the piping joint 152 may be altered in accordance with the configuration of a particular regular polygon and thus by the number of corners of the particular polygon.

In this case, it should be noted that although a bolt 159 becomes necessary which is capable of fastening a pressure plate 160 with an intensive force in order to squeeze the O-ring 158 to a sufficient degree, such a bolt will not give rise to any problem whatsoever since it will not project from the piping joint 152.

According the above mentioned fifth embodiment of the present invention in this way, it becomes possible to shorten the length along which the fitting portion 153 of the piping joint 152 is fitted into the piping joint attachment hole 141 of the spring box 140 while providing a required sealing with certainty. Therefore, since the piping joint attachment hole 141 of the spring box 140 can be shortened, it follows that the length of the spring box 140 will be shortened to reduce the entire length of the pilot operated directional control valve, thereby reducing its site area as required.

Also, the piping joint 152 inserted can be prevented from being removed by the pressure plate 160. Further, since the fitting portion 153 in a polygonal configuration is fitted in the piping joint attachment hole 141 in a polygonal configuration, it will be seen that the piping joint 152, without any fear of its subsequent rotation, can be, and does remain, attached firmly in place. In other words, the orientation of the pipe connecting portion 154 of the L-shaped piping joint 152 may be maintained always constant. And yet, it is also possible to alter its orientation as desired.

Figure 15:
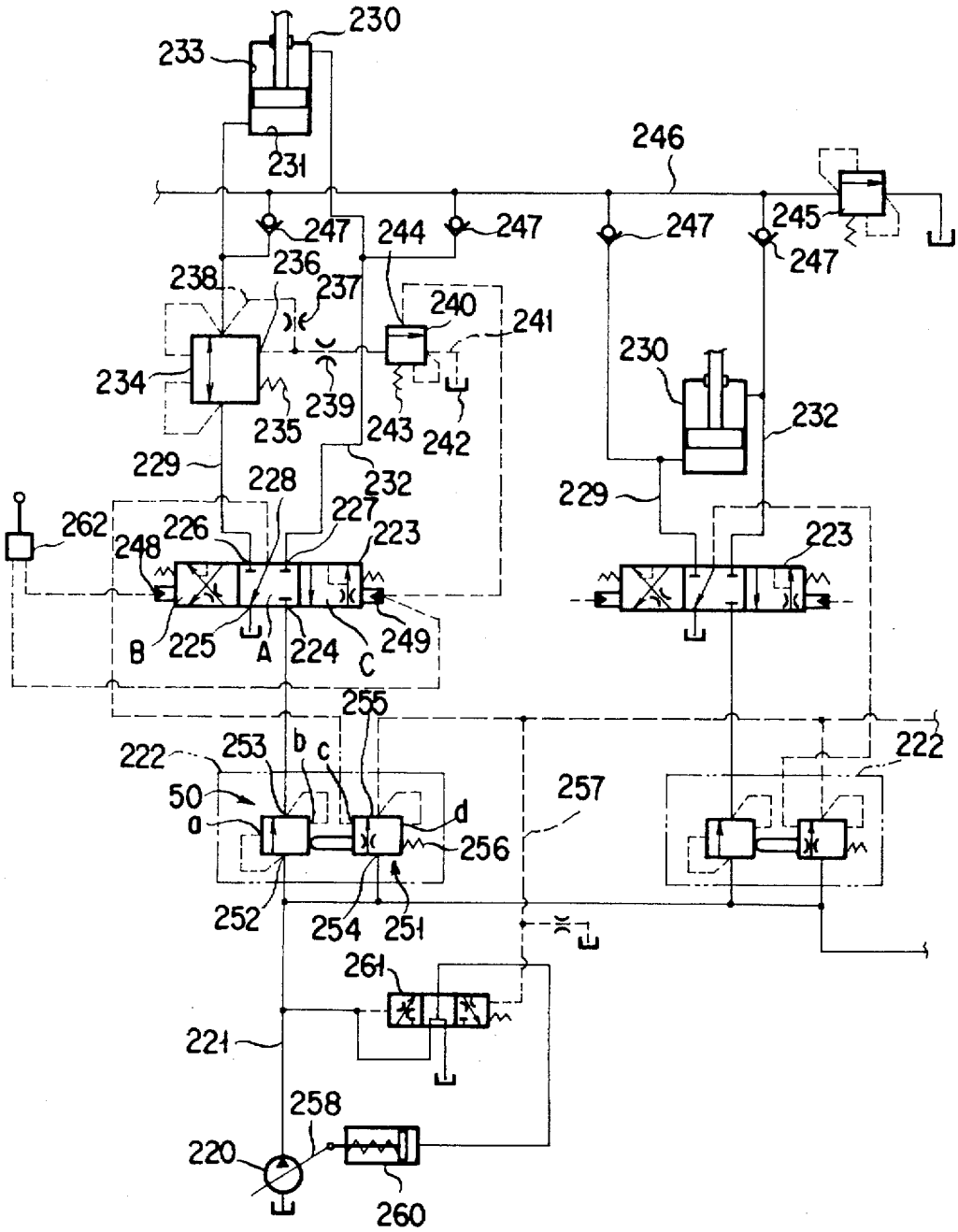
FIG. 15 is a hydraulic circuit diagram of an operating cylinder control apparatus which constitutes a sixth embodiment of the present invention.

FIG. 15 is a hydraulic circuit diagram of an operating cylinder control apparatus that represents a sixth embodiment of the present invention. As shown in FIG. 15, a hydraulic pump 220 has its discharge path 221 that is provided with a plurality of pressure compensation valves 222, each of which has an output side provided with a directional control valve 223. The directional control valve 223 is designed to establish and block communications among a pump port 224, a tank port 225, a first and a second actuator port 226 and 227 and a load pressure detecting port 228. The first actuator port 226 of the directional control valve 223 is connected to a retention pressure generating chamber 231 of an operating cylinder 230 via a first circuit 229 whereas the second actuator port 227 thereof is connected to the other chamber 233 of the operating cylinder 230 via a second circuit 232.

The above mentioned first circuit 229 is provided therein with a locking valve 234, which is designed to assume a thrusting action in the direction of communication under a pressure of the first circuit 229 and a thrusting action in the direction of blocking both by a spring 235 and under a pressure of a pressure receiving portion 236. The pressure receiving portion 236 has a pressure of the retention pressure generating chamber 231 of the operating chamber 230 exerted thereon through a circuit 238 provided with a throttle 237. Also, the pressure receiving portion 236 is connected to a reservoir 242 through a drain path 241 provided with a throttle 239 and a switching valve 240, and the switching valve 240 is held at its blocking position by a spring 243 and is arranged to assume a thrusting action to its communicating position under a pressure of a pressure receiving portion 244.

Numeral 245 represents a main relief valve. A circuit 246 upstream of the main relief valve 245 is connected via a check valve 247 to the side to the operating cylinder 230 of the locking valve 234 in each first circuit 229 and is also connected via the check valve 247 to each second circuit 232. This arrangement is so made that when the highest pressure in each first circuit 229 and each second circuit 232 exceeds a preset pressure of the main relief valve 245, the latter may operate so as to be relieved.

With such an arrangement adopted, only a single main relief valve alone is made sufficient for use in a circuit assembly provided with a plurality of operating cylinders.

The above mentioned directional control valve 223, when no pilot pressure is acting thereon, will act to block both communication between the pump port 224 and the first actuator port 226 and a communication between the pump port 224 and the second actuator port 227, and is thus held at its neutral position A which serves to communicate the load pressure detecting port 228 with the tank port 225. It will be switched to a first pressure fluid supply position B with a pressure fluid delivered into a first pressure receiving chamber 248, and to a second pressure fluid supply position C with a pressure fluid delivered into a second pressure receiving chamber 249.

If the directional control valve 223 is switched to assume the first pressure fluid supply position B, the pump port 224 will communicate with both the first actuator port 226 and the load pressure detecting port 228, and the second actuator port 227 will communicate with the tank port 225. On the other hand, if it is switched to assume the second pressure fluid supply position C, the pump port 224 will communicate with both the second actuator port 227 and the load pressure detecting port 228, and the first actuator port 226 will communicate with the tank port 225.

The above mentioned pressure compensation valves 222 are each provided therein with a check valve 250 and a pressure reduction valve portion 251. The check valve 250 is designed to assume a thrusting action in the direction of communication under an inlet side pressure acting on a pressure receiving portion a and a thrusting action in the blocking direction under an outlet side pressure acting on a pressure receiving portion b. Its inlet 252 is connected to the discharge path 221 whereas its outlet 253 is configured to communicate with the pump port 224 of the directional control valve 223.

The above mentioned pressure reduction valve portion 251 is designed to assume a thrusting action towards the direction in which the inlet 254 and the outlet 255 may communicate with each other under a pressure acting on pressure receiving portion c, to block a communication between the inlet 254 and the outlet 255 both by a spring 256 and under a pressure acting on a pressure receiving portion d, and to assume a thrusting action towards the direction in which the check valve 250 may be blocked. Here, the pressure receiving portion c is connected to the load pressure detecting port 228 of the directional control valve 223, the pressure receiving portion d is connected to the outlet 255, and the inlet 254 is connected to the discharge path 221.

Further, the outlet 255 of each pressure compensation valve 222 is arranged to communicate with, and is connected to, a load pressure detecting path 257 so that when a plurality of directional control valves 223 is at the same time operated to simultaneously actuate a like plurality of operating cylinders 230, a highest load pressure may cause each pressure compensation valve 222 to be brought into its set state, thereby enabling the plural operating cylinders 230 with varying load pressures to be supplied with the pressurized discharge fluid from a single hydraulic pump simultaneously.

It should be noted that the above mentioned hydraulic pump 220 is of the variable capacity type in which its capacity is increased and decreased by changing the inclination angle of its swash plate 258. A cylinder 260 for controlling the inclination angle of the swash plate 258 is here adapted to be supplied with the pump discharge pressure through a control valve 261, which is arranged to be switchable both under the discharge pressure of the pump 220 and under the load pressure of the load pressure detecting path 257.

The pressure compensation valve 222, the cylinder 260 for rotating the swash plate 258 with a controlled inclination angle and the control valve 261, which are mentioned above, are here provided to allow the discharge pressure fluid from the single hydraulic pump 220 alone to be supplied simultaneously to a plurality of the operating cylinders 230. Thus, it is understood that such a combination may be unnecessary either if only a single operation cylinder 230 is to be actuated or if there is no need to actuate a plurality of such operating cylinders 230 at the same time.

Further provided is a pilot valve 262 for furnishing a pilot pressure fluid into the first and second pressure receiving chambers 248 and 249 of each directional control valve 223. The pilot pressure fluid in the second pressure receiving chamber 249 is supplied to the pressure receiving portion 244 of the switching valve 240.

An explanation will now be given with respect the operation of the above mentioned sixth embodiment of the present invention.

When a pilot pressure is not applied from the pilot valve 262 to the pressure receiving portion 248 or 249 of a directional control valve 223 and thus the directional control valve 223 is held at its neutral position A, the pilot pressure is not applied to the pressure receiving portion of the switching valve 240, either, so that the latter may be in a blocking state. Then, since the pressure (i. e., the retention pressure) within the retention pressure generating chamber 231 of a operating cylinder 230 acts on the pressure receiving portion 236 of the locking valve 234 so that the latter may be held at a blocking position by the spring 235, the pressure fluid may not flow through the directional control valve 223, and thus may not leak into any reservoir, thereby effectively preventing any operating cylinder from suffering a spontaneous fall. At this stage, however, the retention pressure, which acts on the main relief valve 245, is lower than a preset pressure therein and hence the main relief valve 245 will remain inoperative.

It should be noted at this point that if the pressure within the retention pressure generating chamber 231 tends to be abnormally elevated due to an inertia load or an external force in the above mentioned state, any elevated pressure will then act on the relief valve 245 through the check valve 247 and if it exceeds the preset pressure in the main relief valve 245, the latter will act to be relieved to permit the excessive pressure fluid to flow into the reservoir, thereby preventing the retention pressure from rising abnormally.

Also, when the pilot valve 262 is operated to supply the pilot pressure fluid into the first pressure receiving chamber 248 of the directional control valve 223, the directional control valve 223 will be switched to the first pressure supply position B. Then, the pressure fluid will be supplied to the first circuit 229 to cause the locking valve 234 to open.

Also, when the pilot valve 262 is operated to supply the pilot pressure fluid into the second pressure receiving chamber 249 of the directional control valve 223, the directional control valve 223 will be switched to the second pressure fluid supply position C. At the same time, the pressure fluid will be supplied to the pressure receiving portion 244 of the switching valve 240 to bring the latter to the position of communication. As a result, since the drain path 241 of the locking valve 234 is brought into a communication with the reservoir 242, the locking valve 234 will open to allow the pressure fluid to flow out of the retention pressure generating chamber 231 of the operating cylinder 230 into the tank port 225 of the directional control valve 223.

An explanation will next be given with respect to a specific structure of the directional control valve 223 for use in the present embodiment of this invention.

Figure 16:
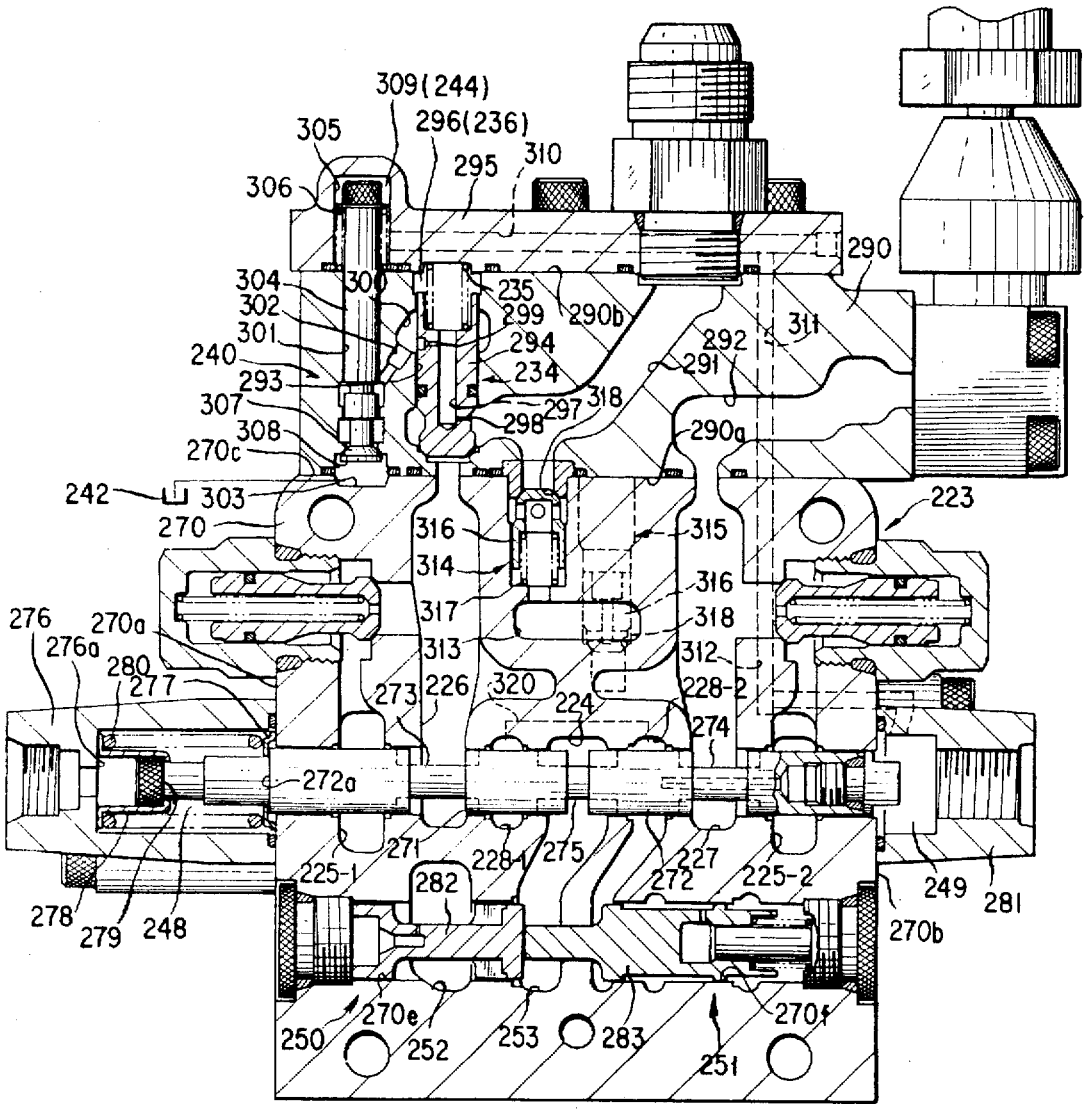
FIG. 16 is a cross sectional view illustrating a specific structure of the directional control valve for use in the above mentioned sixth embodiment of the present invention.

As shown in FIG. 16, the directional control valve 223 has a valve block 270 formed therein with a spool bore 271 to which a pump port 224, a first and a second load pressure detecting port 228-1 and 228-2, a first and a second actuator port 226 and 227 and a first and a second tank port 225-1 and 225-2 are opened. A spool 272 is fittingly inserted in the spool bore 271 and is slidably displaceable therein to establish and block communications among these ports mentioned above. It should be noted here again that the first and second load pressure detecting ports (228-1 and 228-2) remain in communication with each other, here via a fluid bore 320.

The above mentioned spool 272 is formed with a first and a second small diameter portion 273 and 274 and an intermediate small diameter portion 275 which serve to block each of the ports mentioned above when the spool 272 is held at its neutral position as shown in FIG. 16. And, if the spool 272 is slidably displaced rightwards in FIG. 16 to take its first pressure fluid supply position, communication will be established each between the pump port 224 and the second load pressure detecting port 228-2 and between the first load pressure detecting port 228-1 and the first actuator port 226. Then, the pressure fluid caused to flow into the pump port 224 will flow into the first actuator port 226. Also, since the second actuator port 227 is then brought into a communication with the second tank port 225-2, the return fluid will now flow out of the second actuator port 227 into the second tank port 225-2.

If the spool 272 is slidably displaced from the state shown in FIG. 16 towards the left hand side to take its second pressure fluid supply position, communication will be established each between the pump port 224 and the first load pressure detecting port 228-1 and between the second load pressure detecting port 228-2 and the second actuator port 227. Then, the pressure fluid introduced into the pump port 224 will flow into the second actuator port 227. Also, since the first actuator port 226 is then brought into a communication with the first tank port 225-1, the return fluid will now flow out of the first actuator port 226 into the first tank port 225-1.

It is seen that a first spring box 276 is attached to one end surface 270*a* of the above mentioned valve block 270 in the longitudinal direction of the spool 272. The first spring box 276 is provided therein with a first spring bearing 277 and a second spring bearing 278 in such a manner that the first spring bearing 277 may be in contact with both the one end surface 270*a* of the valve block 270 and a step portion 272*a* of the spool 272 and the second spring bearing 278 may be in contact with a bottom wall 276*a* and a step portion 279 of the spool 272. A spring 280 is interposed between the first and second spring bearings 277 and 278 such that the spool 272 may be held at its neutral position. Also, the interior of the first spring box 276 constitutes a first pressure receiving chamber 248.

It is also seen that a second spring box 281 is attached to the other end surface 270*b* of the above mentioned valve block 270 and its interior constitutes a second pressure receiving chamber 249.

Beneath the above mentioned valve block 270 there lie a check valve section 250 which is constituted by a check valve bore 270*e* and a spool 280 inserted therein, and a pressure reduction valve section 251 which is constituted by a pressure reduction valve bore 270*f* and a spool 283 inserted therein. The two spools 282 and 283 are aligned so as to oppose each other. Also, the check valve section 250 and the pressure reduction valve section 251 together constitute a pressure compensation valve.

A mating surface 270*c* of the above mentioned valve block 270 is joined and connected with a mating surface 290*a* of a block 290, which is formed therein with a first fluid bore 291 that is opening to the first mating surface 290*a* and a second fluid bore 292. The first fluid bore 291 is designed to communicate with the first actuator port 226 that is opening to the mating surface 270*c* of the valve block 270 whereas the second fluid bore 292 is designed to communicate with the second actuator port 227 that is opening to the mating surface 270*c* of the valve block 270. Further, the first fluid bore 291 is provided with a locking valve 234.

The locking valve 234 includes a poppet 294 which is fittingly inserted in a valve bore 293 that is open to a second mating surface 290*b* of the block 290 and which is being pushed by a spring 235 in its closing direction. The spring 235 is received in a spring chamber 296 (which represents the pressure receiving portion 236 in FIG. 15) that is defined by a cap 295 which is mounted on the second mating surface 290*b* of the block 290. Also, the spring chamber 296 is open to the first fluid bore 291 through an axial bore 297 and a narrow bore 298 (which collectively represent the circuit 238 including the throttle 237 in FIG. 15) that are formed in the poppet 294. Here, the axial bore 297 is designed to communicate with a port 300 of a valve bore 293 through a narrow bore 299.

The above mentioned block 290 is formed therein with a bore 301 that is open to both the first mating surface 290*a* and the second mating surface 290*b*. The bore 301 is designed to communicate with the above mentioned port 300 through a fluid bore 302, and also to communicate with a reservoir 242 through a recess 303 that is formed in the mating surface 290*a* of the block 290. Also, the bore 301 has a valve 304 fittingly inserted therein which constitutes the above mentioned switching valve 240. The valve 304 has one end facing a blind hole 305 in the cap 295 and is arranged to be energized unidirectionally by a spring 306 so that a conical portion 307 formed at its other end may be in contact with a sheet 308 so as to block a communication between the above mentioned port 300 and the above mentioned recess 303. Also provided is a spring chamber 309 (which represents the pressure receiving portion 244 in FIG. 15) that is designed to communicate with the above mentioned second pressure chamber 249 through a bore 310 which is formed in the cap 295, a fluid bore 311 which is formed in the block 290 and a fluid bore 312 which is formed in the valve block 270, so that the pressure fluid in the second pressure receiving chamber 249 may flow into the spring chamber 309 through the fluid bores 312, 311 and 310 to push up the valve 304 and that the conical portion 307 may thereby be departed from the sheet 308 to establish communication between the port 300 and the recess 303, thereby permitting the pressure fluid within the first fluid bore 291 to flow into the reservoir 242. These components here collectively constitute the above mentioned switching valve 240.

The above mentioned valve block 270 is formed therein with a drain port 313, which is designed to communicate with the first fluid bore 291 through a first check valve 314 and also to communicate with the second actuator port 227 through a check valve 315. The first and second check valves 314 and 315 comprise a valve 316 that is attached by a spring 317 to a sheet 318 under a pressure. Here, the first check valve 314 allows the pressure fluid to flow from the first fluid bore 291 to the drain port 313 whereas the second check valve 315 allows the pressure fluid to flow from the second actuator port 227 to the drain port 313.

Figure 17:
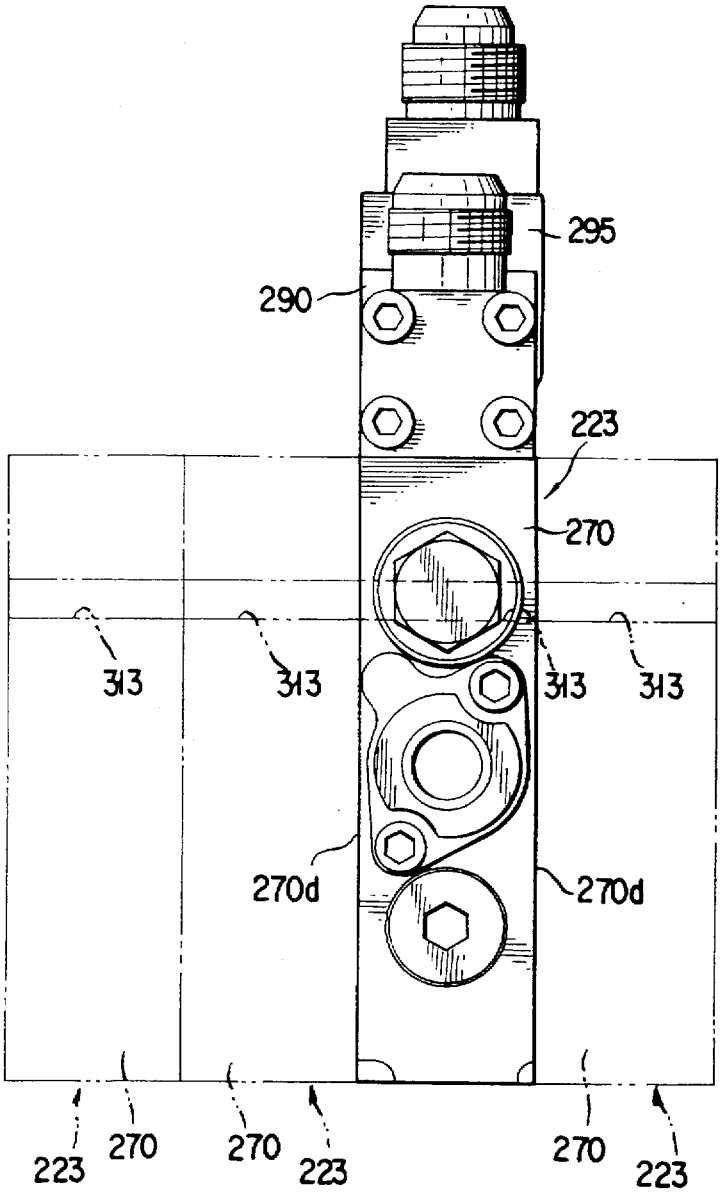
FIG. 17 is a right hand side view of the structure shown in FIG. 16.

As shown in FIG. 17, drain ports 313 as mentioned above, respectively, for a plurality of blocks 270, are designed to be each open to adjacent block joining surfaces 270*d* at both sides of each block 270 in the direction of its width and are designed to be interconnected by joining together the respective blocks 270 of such a plurality of directional control valves 223. Also, a main relief valve 245 is attached to the valve block 270 that is located at an end of a series of such valve blocks 270.

As will be apparent from the foregoing description, it can be seen that according to the sixth embodiment of the present invention in which a main relief valve 245 for preventing an abnormally elevated pressure within the retention pressure generating chamber 231 of an operating cylinder 230 can be placed separately, it will be sufficient to provide only a locking valve 234 and a switching valve 240 correspondingly to each of the operating cylinders 230. And yet, since the main relief valve 245 can commonly act for a plurality of operating cylinders 230, the area of the site on which a unit for preventing a spontaneous fall of any of the plural operating cylinders 230 is mounted may be reduced. Also, since it suffices to provide such a single main relief valve 245 alone, it can be seen that the equipment may be made less costly.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. A pilot pressure operated directional control valve in which a housing is formed therein with a spool bore having a plurality of ports, said spool bore has a spool fittingly inserted therein so as to be slidably displaceable therein, said spool is adapted to be slidably displaced both with a spring and under a pilot pressure led into a pressure receiving chamber, a spring box is attached to an end surface of said housing in a longitudinal direction of said spool, and said spring box is adapted to be formed with a hollow portion containing said spring and forming a pressure receiving chamber, and a pilot pressure fluid inlet for communicating with said hollow portion and opening in the longitudinal direction of said spool, in which:

pilot pressure fluid inlet is formed with a piping joint attachment hole; said piping joint attachment hole is constituted of a large diameter hole and a small diameter hole which are eccentric to each other; said piping attachment joint is constituted of a fitting portion comprising a large diameter portion and a small diameter portion which are eccentric to each other and a pipe connecting portion; said fitting portion is adapted to be fittingly inserted into said piping joint attachment hole; and a pressure plate is bolted with said spring box to act to prevent said fitting portion from coming out of a piping joint attachment hole.

2. A pilot pressure operated directional control valve as set forth in claim 1, in which an interstice between an inner peripheral portion of said piping joint attachment hole and an outer peripheral portion of said fitting portions is adapted to be sealed by a sealing material.

3. An operating cylinder control apparatus, which comprises:

a directional control valve;

a locking valve which is disposed in a circuit for interconnecting an actuator port of said directional control valve and a retention pressure generating chamber of an operating cylinder, which has a pressure receiving portion and a spring, which is adapted to be thrust in a direction of communication by an outlet pressure of said directional control valve and the retention pressure within said operating cylinder and which is adapted to be thrust in a direction of blocking by said spring and said retention pressure within said operating cylinder, said retention pressure acting on said pressure receiving portion;

a switching valve which is disposed between said pressure receiving portion of said locking valve and a reservoir, which is energized by a spring into a blocking position and which is adapted to take a communicating position by means of a switching means brought into a position for communicating said circuit with a reservoir; and a main relief valve which is connected via a check valve to a side of said operating cylinder of said locking valve in said circuit, wherein said main relief valve is adapted to be connected to sides of a plurality of operating cylinders.

4. An operating cylinder control apparatus, as set forth in claim 3, in which:

a valve block equipped with said locking valve and said switching valve is connected to a valve block of said directional control valve; an inlet side of said locking valve is adapted to communicate with the actuator port of said directional control valve; and each of said valve blocks is formed therein with a fluid hole for communicating the pressure receiving portion on which said pilot pressure of said directional control valve is acting with the pressure receiving portion of a side to said spring of said switching valve.

5. An operating cylinder control apparatus, which comprises:

a directional control valve which is provided with a first pressure receiving chamber, a second pressure receiving chamber, a pump port, a tank port and a first and second actuator port, said directional control valve which when at its neutral position is adapted to block said first and second actuator ports, which when at its first pressure fluid supply position is adapted to communicate between said pump port and said first actuator port and to communicate between said second actuator port and said tank port, and which when at its second pressure fluid supply position is adapted to communicate between said pump port and said second actuator port and to communicate said first actuator port and said tank port;

a first circuit for connecting said first actuator port to a retention pressure generating chamber of an operating cylinder;

a second circuit for connecting said second actuator port to a second chamber of said operating cylinder;

a locking valve which is disposed in said first circuit, which is adapted to be thrust in a direction of communication both under a pressure of said first actuator port and under a pressure within said retention pressure generating chamber of said operating cylinder, and which is adapted to be thrust in a direction of blocking both by a spring and under the pressure within said retention pressure generating chamber acting on a pressure receiving portion of said locking valve;

a switching valve which is disposed in a drain path connected to said pressure receiving portion of said locking valve, which is held at a blocking position by a spring and which is brought into a communicating position under a pressure at a pressure receiving portion of said switching valve;

a main relief valve which is connected to a side of said retention pressure generating chamber and said second chamber of said operating cylinder by said first circuit and said second circuit via respective check valves, and said second pressure receiving chamber of said directional control valve is connected to said pressure receiving portion of said switching valve.

6. A pilot pressure operated directional control valve comprising:

a housing having a spool bore formed therein, said spool bore having a plurality of ports;

a spool fittingly inserted in said spool bore so as to be slidably displaceable therein;

a spring box attached to an end surface of said housing along a longitudinal direction of said spool, said spring box comprising a first hollow cylindrical body having an open end which is attached to said housing, and a second hollow cylindrical body integrally connected in parallel to said first hollow cylindrical body and having an open end opening in the longitudinal direction of said spool and located at an opposite side of said spring box relative to said open end of first hollow cylindrical body, wherein said first hollow cylindrical body defines an interior pressure receiving chamber, said open end of said second hollow cylindrical body defines a pilot pressure fluid inlet and said open end also serves as a piping joint attachment hole having an inner peripheral surface in the shape of a regular polygon, and said pressure receiving chamber is in fluid communication with an interior space formed in said second hollow cylindrical body; and a spring disposed in said pressure receiving chamber of said first hollow cylindrical body.

7. The pilot pressure operated directional control valve as claimed in claim 6, further comprising:

a piping joint connected to said pilot pressure fluid inlet, said piping joint including a pipe connecting portion and a fitting portion having the shape of a regular polygon, said fitting portion being adapted to be fittingly inserted into said piping joint attachment hole; and a pressure plate for securing said fitting portion in said piping joint attachment hole.

8. The pilot pressure operated directional control valve as claimed in claim 7, wherein said pressure plate is bolted to said spring box.

9. The pilot pressure operated directional control valve as claimed in claim 7, further comprising a sealing material provided between a bottom portion of said piping joint attachment hole and an end surface of said fitting portion.

10. A pilot pressure operated directional control valve comprising:

a housing having a spool bore formed therein, said spool bore having a plurality of ports;

a spool fittingly inserted in said spool bore so as to be slidably displaceable therein;

a spring box attached to an end surface of said housing along a longitudinal direction of said spool, said spring box comprising a first open end which is attached to said housing, and a second open end which opens in the longitudinal direction of said spool and is located at an opposite side of said spring box relative to said first open end, wherein said spring box defines an interior pressure receiving chamber, and said second open end defines a pilot pressure fluid inlet which also serves as a piping joint attachment hole having an inner peripheral surface in the shape of a regular polygon; and a spring disposed in said interior pressure receiving chamber.

11. The pilot pressure operated directional control valve as claimed in claim 10, further comprising:

a piping joint connected to said pilot pressure fluid inlet, said piping joint including a pipe connecting portion and a fitting portion having an outer surface in the shape of a regular polygon, said fitting portion being adapted to be fittingly inserted into said piping joint attachment hole; and a pressure plate secured to said spring box to prevent said fitting portion from coming out of said piping joint attachment hole.

12. The pilot pressure operated directional control valve as claimed in claim 11, wherein said pressure plate is bolted to said spring box.

13. The pilot pressure operated directional control valve as claimed in claim 11, further comprising a sealing material provided between a bottom portion of said piping joint attachment hole and an end surface of said fitting portion.

* * * * *